US006020097A

United States Patent [19]

Visser et al.

[11] Patent Number: 6,020,097

[45] Date of Patent: Feb. 1, 2000

[54] SINGLE LAYER BIPOLAR ELECTROPHOTOGRAPHIC ELEMENT

[75] Inventors: Susan A. Visser, Rochester; Donald S. Rimai, Webster; Michel F. Molaire, Rochester; Paul M. Borsenberger, Hilton, all of N.Y.

[73] Assignee: Eastman Kodak Company, Rochester, N.Y.

[21] Appl. No.: 09/070,259

[22] Filed: Apr. 30, 1998

[51] Int. Cl.[7] ..... G03G 5/147

[52] U.S. Cl. ..... 430/66; 430/67

[58] Field of Search ..... 430/66, 67

[56] References Cited

U.S. PATENT DOCUMENTS 5,268,247 12/1993 Hayashi ..... 430/67

5,288,573 2/1994 Hung et al. ..... 430/58

5,525,447 6/1996 Ikuno et al. ..... 430/67

*Primary Examiner*—Roland Martin

*Attorney, Agent, or Firm*—Doreen M. Wells

[57] ABSTRACT

A bipolar electrophotographic element comprising a) a single active bipolar photoconductive layer on an electrically conductive support and b) a diamond-like carbon protective layer, having a fluorine content between 0 and 65 atomic percent based on the composition of the entire protective layer, and also having a thickness between 0.05 and 0.5 $\mu$m. Also disclosed is a coating composition for a single bipolar photoconductive layer comprising: i) one or more binder polymers; ii) at least one aggregating dye salt; iii) at least one organic charge transport agent; and iv) a volatile coating solvent.

23 Claims, No Drawings

SINGLE LAYER BIPOLAR ELECTROPHOTOGRAPHIC ELEMENT

CROSS REFERENCE TO RELATED APPLICATIONS

The present invention is related to commonly assigned, concurrently filed U.S. patent application Ser. No. 09/070,290, filed Apr. 30, 1998, entitled "Single-Pass Formation of a Multicolor Electrophotographic Image" of Visser et al. The disclosure of this related application is incorporated herein by reference.

FIELD OF THE INVENTION

The invention relates generally to electrophotographic elements and protective layers. More particularly, it relates to bipolar photoconductive elements having a single photoconductive layer and a protective layer of diamond-like carbon.

BACKGROUND OF THE INVENTION

Electrophotographic imaging processes and techniques have been extensively described in both the patent and other literature. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a visible record of the electrostatic image.

In order to be useful in an electrophotographic process, a photoconductive element must display good photosensitivity and low residual voltage after exposure. Photosensitivity is a measure of the amount of energy required to discharge the photoconductor from an initial voltage to some predetermined potential. The residual voltage is a measure of the charge remaining on the element after exposing the element. The residual voltage is the minimum voltage to which a photoconductive element can be discharged. A high residual voltage can give rise to a lower potential difference between charged and discharged areas of the element on subsequent imaging cycles. Blurred, fogged, or incomplete images result. Hence, for high process efficiency, high photosensitivity and low residual voltage are desired.

Photoconductive elements, also called photoreceptors or photoconductors, are composed of a conducting support and at least one photoconductive layer which is insulating in the dark but which becomes conductive upon exposure to light. The support may be in one of many forms, for example, a drum, a web or belt, or a plate.

Numerous photoconductive materials have been described as being useful components of the photoconductive layer of a photoconductive element used in electrophotography. These include inorganic substances, such as selenium and zinc oxide, and organic compounds, both monomeric and polymeric, such as arylamines, arylmethanes, carbazoles, pyrroles, phthalocyanines and the like. Especially useful are aggregate photoconductive compositions that have a continuous electrically insulating polymer phase containing a finely divided, particulate co-cirystalline complex of at least one pyrylium-type dye salt and at least one polymer having an alkylidenediaiylene group in a recurring unit.

Aggregate compositions used in photoconductive elements can be prepared by several techniques, such as, for example, the dye first technique described in Gramza et al., U.S. Pat. No. 3,615,396, incorporated herein by reference. Alternatively, they can be prepared by the shearing method described in Gramza, U.S. Pat. No. 3,615,415, incorporated herein by reference. This latter method involves the high speed shearing of the photoconductive composition prior to coating and thus eliminates subsequent solvent treatment, as disclosed in Light, U.S. Pat. No. 3,615,414, referred to hereinafter. By whatever method prepared, the aggregate composition is applied with a suitable liquid coating vehicle onto a support or underlying layer to form a separately identifiable multiphase aggregate composition, the heterogeneous nature of which is generally apparent when viewed under magnification, although such compositions may appear to be uniform to the naked eye. There can, of course, be macroscopic heterogeneity. Suitably, the pyrylium type dye-salt-containing aggregate in the discontinuous phase is finely divided, i.e., typically predominantly in the size range of 0.01 to 25 $\mu$m.

Photoconductive elements can comprise single or multiple active layers. In a single layer photoconductive element, charge generation (the photogeneration of charge carriers, i.e. electrons and holes) and charge transport (the transportation of the generated charge carriers) take place within the same layer. Single active layer aggregate photoconductive elements are described in Light, U.S. Pat. No. 3,615,414, and in Gramza et al., U.S. Pat. Nos. 3,732,180 and 3,615,415. Single active layer aggregate photoconductive compositions have found many commercial applications.

One problem associated with photoconductive elements is a phenomenon known as dark decay. Dark decay describes the decrease in the voltage on the element between the time that it is charged by the charging device and the time that it is exposed to image-wise radiation. Dark decay reduces the potential difference between the charged and discharged areas of the photoconductive element after exposure and can result in improper placement of toner on the image. The result is blurred lines, fogging, and other undesirable artifacts in the final image. Particularly in electrophotographic processes that seek to reproduce high quality images, dark decay is a major limiting factor to preparing a useful photoconductive element.

Most known photoconductive elements display useful electrophotographic properties, including good photosensitivity, low residual voltage, and acceptable dark decay, only when subjected to one polarity (positive or negative) of charging. These are known as monopolar photoconductive elements. A monopolar photoconductive element designed for use with positive charging will have high photosensitivity when charged positively; however, the element will have little or no photosensitivity if it is charged negatively. A similar situation occurs for monopolar photoconductive elements designed for use with negative charging. This produces a limitation on the usefulness of these types of photoconductive elements in many electrophotographic processes.

In particular, electrophotographic processes that use toners of different polarities on the same image or on different images produced in the same apparatus cannot function using only one monopolar photoconductive element. For example, electrophotographic processes that use multiple layers of marking particles, known as toners, to produce color images may advantageously use toners that are charged to different polarities for each layer to produce images of higher quality. Processes that use one or more liquid toners or one or more solid toners or two or more toners of different characteristics, such as melt viscosity, surface roughness or gloss after fixing or fusing, and color or hue, may advantageously use toners of more than one polarity in an electrophotographic process. Such a process often cannot use one monopolar photoconductive element. Further, electrophotographic apparatuses that serve multiple functions, such as photocopier, printer, and facsimile machine, may advantageously use different toners with different charging polarities for each function. Again, such an apparatus often cannot use a single monopolar photoconductive element. While more than one monopolar photoconductive element can be used for such processes, this disadvantageously increases the size and complexity of the electmophotographic apparatus. Further, when two or more toners of different polarity are to be used on the same image, it is extremely difficult, when more than one photoconductive element is used, to maintain registration of the different toners on the image so that the toner is placed precisely in the collect position on the receiver. Failure to register the different toner types correctly gives rise to problems such as ghosting, where one toner is placed in slight misalignment to where it should be positioned on the receiver, and improper color reproduction. These are unacceptable for high quality images.

Single layer aggregate photoconductive compositions can be used when charged either negatively or positively. Thus, photoconductive elements containing a single active aggregate photoconductive layer are known as bipolar single layer photoconductive elements.

A problem associated with bipolar single layer photoconductive elements is that the lifetime of these elements is less than desired. Typically, the photoconductive elements are cycled repeatedly through the electrophotographic process. In each cycle, the photoconductive element is exposed to multiple charging elements, such as the primary, transfer, receiver detachment, and pre-clean erase chargers, that are extremely damaging to the photoconductive element. Exposure to charging elements frequently results in the deposition of chemical species such as nitric acid on the photoconductive element surface, causing a problem called latent image spread (LIS). In severe cases, exposure to the charging elements can also reduce the photosensitivity of the photoconductive element, ending its usefulness in the electrophotographic process. Damage of the photoconductive elements through any of these or other mechanisms caused by exposure of the photoconductive elements to charging elements will be referred to as corona-induced damage.

The lifetime of bipolar single layer photoconductive elements is also less than desired because of physical damage sustained by the elements. Physical damage to the photoconductive element inculcated during the electrophotographic process, from installation or other service procedures, or from foreign objects falling into the electrophotographic engine during normal use, can significantly reduce the lifetime of the element and will impart defects in the images produced. Such defects occur at random time intervals and cannot be treated at normal service intervals.

In order to address the issue of damage to the photoconductive element, protective layers such as sol-gel overcoats are often coated onto the photoconductive element. However, in order to be effective, the charge transport properties of such overcoats must be strictly controlled. If the material is too electrically insulating, it will not permit the photoconductive element to photodischarge when exposed to light. This will result in poor electrostatic latent image formation. Altematively, if the layer is too conducting, the electrical charges forming the electrostatic latent image will spread prior to development. This effect, referred to as latent image spread (LIS), will result in a loss of resolution and blurning of the image. It is particularly unacceptable with high quality electrophotographic engines producing latent images requiring a resolution of 600 dpi or greater. For commonly used materials such as sol-gels, the electrical conductivity is generally controlled by the addition of ionic charge conducting agents to the sol-gel formulation. However, the resistivity of such materials is highly sensitive to the humidity and can be too resistive under some conditions and too conductive under others. Further, the combination of charge conducting agents and commonly used materials such as sol-gels can frequently lead to increased susceptibility to damage from chargers rather than providing the desired protective properties. Finally, such charge agents have been found to tribocharge against commonly used toners, thereby creating image observable artifacts such as background.

It is also important that the charge conduction properties of the entire photoconductive element used in the electrophotographic process be controlled. For example, a highly resistive overcoat may be successfully used with a multilayer photoconductive element to improve its lifetime. However, if the same overcoat is used with a single layer photoconductive element the resulting package may be too insulating to allow adequate photosensitivity. Control of the charge conduction properties of the element is particularly crucial when the element is a bipolar photoconductive element. Protective layers that are useful with monopolar photoconductive elements are designed for one specific charging polarity and may not be useful for the opposite polarity. Thus, protective layers designed for monopolar photoconductive elements may not be useful on bipolar photoconductive elements which require protective layers that are useful with both charging polarities. Therefore, it is important that the electrical properties of the overcoat layer be appropriately matched to those of the photoconductive element if the resulting photoconductive element is to function adequately in its intended use.

Changing the number of layers in a photoconductive element will alter this match in an unpredictable manner. Protective layers designed for multi-layer photoconductive elements may produce image degradation when used on single layer photoconductive elements. Thus, it is desirable to provide a protective layer that is neither too insulating nor too conductive and that is designed for the particular type of photoconductive element of interest.

Protective layers can also change the photosensitivity and residual voltage of the photoconductive element. This can result in loss of contrast between light and dark areas in the final image and in failure to reproduce some or all of an image. The impact of the protective layer on these properties depends on the combination of its properties, for example its absorption at particular wavelengths or its resistivity, with the properties of the photoconductive layers in the element. Thus, it is not obvious that a protective layer that has proven useful with one type of photoconductive element will work for all photoconductive elements.

Yet another problem with protective layers is that their adhesion to the photoconductive layers can be less than desired. Specifically, protective layers such as sol-gels tend to be rather thick (approximately 10 $\mu$m). These tend to crack during use and the cracks frequently propagate through the photoconductive layers, resulting in a delamination of these layers from the support layer. Adhesive failure alone can produce image defects, and it can allow scratching or abrasion of the photoconductive element that produces image defects and decreases the element's lifetime. Adhesive failure is particularly a problem where the photoconductive element comprises a flexible support without end, also known as a web or belt. In this instance, the web must bend around rollers of various radii and is flexed severely, thereby aggravating crack formation and delamination.

Monopolar photoconductive elements having diamond-like carbon (DLC) protective layers are known. Single layer and multi-layer monopolar photoconductive elements having DLC protective layers are known. For example, U.S. Pat. No. 4,965,156 to Hotomi et al. discloses the use of two protective layers on a monopolar, organic single layer or multi-layer photoconductive element. The first protective layer is an DLC layer which includes more than 5 atomic percent fluorine. The second, outermost protective layer is a similar material except that the fluorine content must be lower than 5 atomic percent. Layer thicknesses disclosed are 0.01 to 4.0 $\mu$m for the first layer and 10 to about 400 angstroms (0.001 to about 0.04 $\mu$m) for the second layer. Hotomi et al. teach that if the fluorine content is above 5 atomic percent in the outermost layer, it causes image fogging. Fogging can be detected by measurements of latent image spread. This invention has several disadvantages for practical application. First, it necessitates the deposition of two protective layers of differing composition, increasing the manufacturing complexity and cost of the element. Second, the useful lifetime of the element is limited by the lifetime of the second or outermost protective layer. If the outermost layer is worn away or abraded such that any part of the first protective layer is exposed, Hotomi et al. teach that image fogging will result. Failure to deposit a defect-free second layer has the same result and is extremely likely because of the very low thickness of the layer. A method of providing protection to a photoconductive element which does not cause image fogging would be advantageous. The patent of Hotomi does not disclose bipolar photoconductive elements.

U.S. patent application Ser. No. 08/639,374 to Visser et al. discloses the use of fluorinated diamond-like carbon outermost layers on an organic, multi-layer photoconductive elements comprising charge transport layers containing arylamine. Fluorine concentrations of 25–65 atomic percent are claimed. Only multi-layer photoconductive elements are disclosed. Outermost layers of 0.05 to 0.5 $\mu$m thickness are claimed. Only monopolar photoconductive elements are disclosed.

U.S. patent applications Ser. Nos. 09/023,596, now U.S. Pat. No. 4,849,445; 09/023,631 now U.S. Pat. No. 4,849,443; 09/023,896; and 09/023,901; concurrently filed on Feb. 13, 1998; to Visser et al. disclose multilayer photoconductive elements having two or more charge generation layers, at least one charge transport layer, and a diamond-like carbon protective layer with a fluorine content of between 0 and 65 atomic percent based on the composition of the protective layer. Outermost layers of 0.05 to 0.5 $\mu$m thickness are claimed. Only monopolar photoconductive elements are disclosed.

U.S. Pat. No. 5,240,802 to Molaire et al. discloses the use of a silicon carbide surface layer on a bipolar photoconductive element. The photoconductive element contains a single aggregate photoconductive layer and has a surface with a 20° gloss measurement value greater than about 6. While useful as a protective layer, silicon carbide is typically formed from gases such as silane ($SiH_4$) which are difficult and dangerous to use, making them undesirable from a manufacturing standpoint. The difficulty of manufacturing silicon carbide layers also makes them expensive to use.

There is a need to provide useful bipolar single layer photoconductive elements with improved resistance to corona-induced and physical damage. In order to be considered to be a useful photoconductive element, the element must possess the following characteristics: good photosensitivity and low residual voltage with both charging polanities, low dark decay, and no latent image spread under a range of ambient humidity conditions with both charging polarities. Bipolar single layer photoconductive elements possessing these characteristics, as well as improvements in resistance to corona-induced and physical damage, would be significant improvements over the prior art.

SUMMARY OF THE INVENTION

It is an object of the present invention to provide bipolar photoconductive elements having a conductive support and a single photoconductive layer that have improved resistance to corona-induced and physical damage.

The bipolar photoconductive element of the present invention comprises a) a single active bipolar photoconductive layer on an electrically conductive support and b) a diamond-like carbon protective layer, preferably a single layer of uniform composition, wherein the fluorine content of said protective layer is between 0 and 65 atomic percent based on the composition of the entire protective layer, preferably 10 to 65 atomic percent, more preferably 25 to 50 atomic percent, and wherein the thickness of said protective layer is between 0.05 and 0.5 $\mu$m, preferably 0.15 to 0.35 $\mu$m.

The single active photoconductive layer of the bipolar photoconductive element preferably comprises:

a) an aggregate photoconductive material comprising a continuous polymer phase and heterogeneously dispersed therein a complex of (i) at least one polymer having an alkylidene diarylene group in a recurring unit. and (ii) at least one pyrylium dye salt, and b) at least one organic charge transport agent in said continuous polymer phase. It is preferable that the polymer having an alkylidene diarylene group be a polycarbonate, more preferably bisphenol-A polycarbonate.

It has been found unexpectedly that the bipolar single layer photoconductive element of the present invention displays good photosensitivity, low residual voltage, and low dark decay under both positive and negative charging and low LIS over a range of ambient humidities, while also having improved resistance to corona-induced and physical damage.

Further there is provided a coating composition comprising:

i) one or more binder polymers, at least one of which is preferably an aggregating polycarbonate, more preferably bisphenol-A polycarbonate;

ii) at least one aggregating dye salt, preferably a pyrylium dye salt;

iii) at least one organic charge transport agent; and iv) a volatile coating solvent.

Also provided is a method of making a bipolar photoconductive element comprising the steps of:

a) coating and drying the claimed coating composition on an electrically conductive support, thereby forming a single photoconductive layer; and b) after said photoconductive layer is formed, forming a protective layer comprising diamond-like carbon on said photoconductive layer by contacting said photoconductive layer with a feed gas comprising at least one of a hydrocarbon compound or a fluorocarbon compound, wherein said compound is in the gas phase, and decomposing said compound in the gas phase by a plasma-enhanced chemical vapor deposition process.

Fuither, there is provided an electrophotographic apparatus comprising:

a) a charging means;

b) an exposure means;

c) a bipolar photoconductive element having improved resistance to corona-induced and physical damage, said element comprising a conductive support, a single bipolar photoconductive layer, and a protective layer comprising diamond-like carbon, wherein the fluorine content of said protective layer is between 0 and 65 atomic percent; and d) a development station including electrophotographic developer, e) a transfer means, and f) a fusing means.

The present invention improves resistance to corona-induced damage to bipolar photoconductive elements and also improves resistance to physical damage of bipolar photoconductive elements.

The element of the invention contains a diamond-like carbon protective layer on a bipolar photoconductive element having a conductive support and a single photoconductive layer. In contrast to prior art, this photoconductive element is bipolar and has increased resistance to corona-induced and physical damage while also having good electrophotographic properties and adhesion between layers. The electrophotographic properties are characterized by good photosensitivity, low residual voltage, low dark decay, and no latent image spread (LIS) over a range of ambient humidity conditions and under both positive and negative charging.

DETAILED DESCRIPTION OF THE INVENTION

The present invention produces a bipolar photoconductive element, comprising an electrically conductive support, a single photoconductive layer, and a diamond-like carbon (DLC) protective layer, that has improved resistance to corona-induced and physical damage and is useful as a photoconductive element, also referred to herein as a photoconductor, in an electrophotographic apparatus, such as, copiers or printers.

It has been found unexpectedly that the bipolar single layer photoconductive element of the present invention displays good photosensitivity, low residual voltage, and low dark decay under both positive and negative charging and low LIS over a range of ambient humidities, while also having improved resistance to corona-induced and physical damage.

As used herein, the following terms have the meanings indicated.

"Sensitivity" is the reciprocal of the energy required to discharge the photoconductive element from an initial potential to a final potential that is half the initial potential. Standard values of the initial and final potentials are 500 V and 250 V, respectively. Sensitivity is measured in $cm^2/erg$.

A "bipolar photoconductive element" is a photoconductive element that, when charged positively, displays a sensitivity within a factor of two of the sensitivity displayed by the element when it is charged negatively. If the sensitivity of the element when it is charged positively is denoted $S^+$, and the sensitivity of the element when it is charged negatively is $S^-$, the photoconductive element is a bipolar photoconductive element if $S^+=\alpha S^-$, where ox values from 0.5–2.0 and $S^+$ and $S^-$ are measured in $cm^2/erg$.

An "aggregate photoconductive material" is a material containing a finely divided, particulate photoconductive co-crystalline complex of at least one aggregating dye salt and at least one aggregating binder polymer.

An "aggregating dye" is a dye salt, preferably of the pylylium type, that forms a photoconductive co-crystalline complex with an aggregating binder polymer.

An "aggregating binder polymer" is a polymer having an alkylidene diarylene repeating unit, preferably a polycarbonate, that forms a photoconductive co-crystalline complex with an aggregating dye.

A "seed composition" is a composition containing small preformed dye-polymer aggregate particles that are nucleating sites for the formation of a particulate photoconductive co-crystalline complex of aggregating dye salt and aggregating binder polymer.

The DLC protective layer is also known as an amorphous carbon layer or a plasma-polymerized amorphous carbon layer. When fluorine is included in the film composition, the protective layer may be called a fluorinated diamond-like carbon (F-DLC), fluorinated amorphous carbon, or plasma-polymelized fluorocarbon layer. The protective layer is preferably formed by plasma-enhanced chemical vapor deposition (PE-CVD), also known as glow-discharge decomposition, using an alternating current (AC) or direct current (DC) power source. The AC supply preferably operates in the radio or microwave frequency range. Selection of PE-CVD processing parameters, such as power source type or frequency, system pressure, feed gas flow rates, ineit diluent gas addition, substrate temperature, and reactor configuration, to optimize product properties is well known in the ait. The protective layer may comprise a single layer having a uniform composition or one or more multiple layers of nonuniform compositions; however, it is preferred that the protective layer is a single layer having a uniform composition. Further, the protective layer can be formed by a single or multiple passes through, for example, the PE-CVD apparatus or reactor; however, it is preferred that the protective layer is formed by a single pass through the PE-CVD apparatus or reactor. PE-CVD reactors are commercially available from, for example, PlasmaTherm, Inc.

The fluorine content of the protective layer can be between 0 and 65 atomic percent, preferably between 10 and 65 atomic percent, more preferably 25 and 50 atomic percent. Layers formed using plasma-assisted methods tend to be highly crosslinked films that do not exhibit long range order or a characteristic repeat unit like conventional polymers.

As noted, the atomic percent of fluorine in the protective layer can be between 0 and 65 atomic percent. The atomic percent of fluorine in the protective layer can be determined using X-Ray Photoelectron Spectroscopy (XPS). This is a well known technique for analyzing the composition of thin films. A typical measurement is described in detail in Example 1.

Feed gases that are preferred to be used to prepare the plasma-polymerized coatings. that is, the protective layer, used in this invention include sources of carbon.

Sources of carbon include hydrocarbon compounds. The preferred hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; and aromatic compounds. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tibutane, methylheptane, dimethylhexane, tuimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, borylene, camphene, tiicyclene, bisabolene, zingiberene, curcumene, humalene, cadinenesesquibenihene, selinene, caiyophyllene, santalene, cedrene, camphorene, phyllocladene, podocarprene, mirene, and the like; benzene, toluene, xylene, hemnimellitene, pseudocumene, mesitylene, prelhnitene, isodurene, durene, pentamethyl-benzene, hexamethylbenzene, ethylbenzene, propylbenzene, cumene, styrene, biphenyl, teiphenyl, diphenylmethane, trphenylmethane, dibenzyl, stilbene, indene, naphthalene, tetralin, anthracene, phenanthrene, and the like. The hydrocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the hydrocarbon compound.

The preferTed feed gases used to prepare diamond-like carbon protective layers containing fluorine would include sources of fluorine and carbon. Fluorocarbon compounds include but are not limited to paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2 to 10, preferably 2 to 4, x+y=2n, and x is 2 to 2n, preferably 2n; acetylenic fluorocarbons represented by $C_nF_xH_y$, where n is 2 to 10 preferably 2, x+y=2n−2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; and fluorinated aldehydes. These fluorocarbon feed compounds may have a branched structure. Examples include hexafluoroethane; tetrafluoroethylene; tetrafluoroethane; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro-1-pentene; decafluoropentene; perfluoro-2-inethylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield the fluorocarbon compound in its gas phase.

Note that these fluorocarbon compounds can also serve as feed gases for producing non-fluorinated DLC coatings, assuming that changes in process conditions or in post-process treatment are used to ensure that no fluorine remains in the final coatings.

Paraffinic, fully fluorinated fluorocarbons and mixtures thereof are preferred. Olefinic or acetylinic hydrocarbons or mixtures thereof are preferred. Hydrogen is usually incorporated into the films in the form of the hydrogen present in the hydrocarbon feed gas. Pure hydrogen may also be used as an additional feed gas. Mixtures of two or more types of hydrocarbons can be used with one or more fluorocarbon compounds. Mixtures of one or more fluorocarbons, one or more hydrocarbons, and hydrogen can be used.

The presence of hydrogen is not required but may be included without loss of desirable properties. Oxygen may also be incorporated into the films from the feed gas or from atmospheric oxygen gained through reaction with free radicals present in the coating as it is removed from the reactor. Oxygen may be included without loss of desirable properties, although it is preferred that the oxygen concentration remain below 25 atomic percent based on the composition of the entire DLC layer.

Inert gases such as argon, helium, neon, xeon, or the like optionally may be fed into the reactor during the deposition of the protective layers in order to control the properties of the coating. The use of inert gases to control coating properties is well known to those skilled in the art.

The thickness of the protective layer is preferably between about 0.05 and 0.5 micrometers ($\mu$m), more preferably between about 0.15 and 0.35 $\mu$m.

The single photoconductive layer contains materials, preferably organic and more preferably organic photoconducting materials, that make the layer capable of bipolar charge generation and transport. This means that the layer is capable of generating and transporting charge carriers under both positive and negative charging. Known charge generation materials include dye polymer aggregates, phthalocyanines, squareness, phenylene, azo-compounds, and trigonal selinium particles. Charge transport materials capable of transporting either electrons or holes are known. Common hole transport materials include arylalkanes, arylamines, hydrazones, and pyrazolines. Examples of electron transport materials include diphenoquinones, anthraquinones, indanes, sulfones, and 2,4,7-trinitro-9-fluorenene. An appropriate combination of charge generation and charge transport materials could be devised to produce a bipolar single photoconductive layer.

A bipolar single photoconductive layer can be produced using charge-transfer complexes of poly(N-vinylcarbazole): 2,4,7-trinitro-9-fluorenone, which are capable of both electron and hole transport.

It is preferred that the bipolar single photoconductive layer be comprised of an aggregate photoconductive composition.

In the manufacture of the preferred bipolar single photoconductive layer, a specifically prepared aggregate photoconductive composition is coated and dried on an electrically conductive support. The supporte can be in the foim of a plate, sheet, web, or drum and can be, for example, a metallic or non-metallic plate, sheet, web, or drum that has an electrically conductive surface.

Electrically conductive supports include, for example, paper (equilibrated to a relative humidity above 50 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly (ethylene terephthalate), etc. Such conductive materials as chromium, aluminum, or nickel can be vacuum deposited on transparent film supports in sufficiently thin layers to allow electrophotographic elements prepared therewith to be exposed from either side of such elements.

In a preferred method for preparing the aggregate composition in the method of the invention, one or more binder polymers, at least one of which is an aggregating polymer, are dissolved in an organic solvent. To this mixture is added a seed composition, which contains small preformed aggregate particles that are nucleating sites for the formation of the dye-polymer aggregate composition. To the resulting mixture are added selected aggregating dyes, organic charge transport agents, and preferably, a coating aid.

Pyirylium type dye salts, especially thiapyrylium and selenapyrylium dye salts, are useful in forming the aggregate compositions. Useful dyes are disclosed in Light, U.S. Pat. No. 3,615,414, incorporated herein by reference.

Particularly useful in forming the aggregates are pyrylium dye salts having the formula:

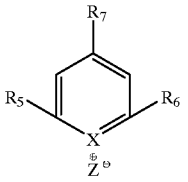

wherein:

$R_5$ and $R_6$ are phenyl groups;

$R_7$ is a dimethylaminosubstituted phenyl group;

X is selenium, sulfur, or tellunium; and

Z is an anion such as perchlorate, tetrafluoroborate, or hexafluoroborate.

The polymers useful in forming the aggregate compositions are electrically insulating, film-forming polymers having an alkylidenediai-ylene group in a resulting unit such as those linear polymers disclosed in Light, U.S. Pat. No. 3,615,414 and Gramza et al., U.S. Pat. No. 3732,180, incorporated herein by reference.

Preferred polymers for forming aggregate compositions are hydrophobic carbonate polymers containing the following group in a recurring unit:

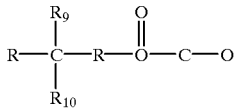

wherein each R is a phenylene group; and $R_9$ and $R_{10}$ are each methyl or, taken together, represent a norbornyl group. Such compositions are disclosed, for example, in U.S. Pat. Nos. 3,028,365 and 3,317,466. Especially preferred are polycarbonates prepared with bisphenol A. A wide range of film-forming polycaibonate resins are useful, with satisfactory results being obtained when using commercial polymeric materials which are characterized by an inherent viscosity of about 0.5 to about 1.8. Specific examples of useful polymers for the aggregate compositions are listed in Table I, Column 13 of U.S. Pat. No. 4,108,657, incorporated herein by reference.

Preferred organic charge transport agents are triarylamines such as tri-p-tolylamine and amino-substituted polyarylalkane photoconductive materials represented by the formula:

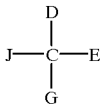

wherein D and G, which may be the same or different, represent aryl groups and J and E, which may be the same or different, represent a hydrogen atom, an alkyl group, or an aryl group, at least one of D, E, and G containing an amino substituent. Especially useful is a polyarylalkane wherein J and E represent a hydrogen atom, an aryl, or an alkyl group, and D and G represent substituted aryl groups having as a substituent thereof a diarylamino group wherein the aryl groups are groups such as tolyl. Additional information concerning certain of these latter polyarylalkanes can be found in Rule et al., U.S. Pat. No. 4,127,412.

The aggregate composition is filtered and coated on a substrate. Any technique for coating these uniform layers on a substrate can be used. When the substrate is a fiat surface such as a sheet, plate, or web, suitable coating methods include extrusion hopper coating, curtain coating, reverse roll coating, dip coating, spray coating, and the like. For coating a drum substrate, a ring coater advantageously is used. After coating, the photoconductive layer on the substrate is dried, for example, by heating in an oven at a temperature from about 80° C. to about 140° C.

The following examples further describe the invention. Examples 1 to 5 demonstrate the improvements in this invention over the prior art, exemplified in Comparative Example 1, while demonstrating that no loss of desirable properties is seen with this invention. Comparative Examples 2 and 3 demonstrate that combinations of prior art on protective coatings for monopolar photoconductive elements would not lead to expectation of success with the invention.

EXAMPLE 1

Bipolar Single Layer Photoconductive Element Having a Diamond-like Carbon Protective Layer A A bipolar single layer photoconductive element was prepared using an aggregate photoconductive layer as follows. The aggregate photoconductive layer formulation was prepared at room temperature. The aggregating dyes were first dissolved in the solvent mixture; the binding polymers and organic charge transport agents were then added. After all the materials were in solution, then seed was added. A phenylmethyl-substituted siloxane with a viscosity of 50 centistokes (DC-510 polysiloxane, obtained from Dow Corning) was used as a coating aid in the formulation. The resulting solution was filtered first through a 2.5 μm, then through a 0.6 μm filter. The formulation used is listed in Table 1 below.

TABLE 1

AGGREGATE PHOTOCONDUCTIVE LAYER COMPOSITION

| Chemical name | Wt. % | Grams |
|---|---|---|
| Lexan ™ 145 polycarbonate | 26.8 | 243.6 |
| Makrolon ™ 5705 polycarbonate | 26.8 | 243.6 |
| Seed | 0.5 | 4.5 |
| Polyester dimethyl terephthalate/ethylene glycol/neo-pentylglycol | 2 | 18.2 |
| 4-((4-dimethylaminophenyl)-2,6-diphenyl)-6-phenyl thiapyrylium hexafluorophosphate | 3.2 | 29.1 |
| 4-(4-dimethylaminophenyl)-2-(4-ethoxyphenyl)-6-phenyl thiapyrylium tetrafluoroborate | 0.8 | 7.3 |
| 1,1-bis(di-4-tolylaminophenyl)cyclohexane | 17.9 | 162.7 |
| tri-p-tolylamine | 17.9 | 162.7 |
| DC-510, phenylmethyl substituted siloxane | 0.18 | 1.6 |
| Dichloromethane | 70 | 567 |
| 1,1,2-trichloroethane | 30 | 242 |

The seed used in the formulation listed in Table 1 was prepared as follows:

To a mixture of 1155 grams of dichloromethane and 493.5 grams of 1,1,2-trichloroethane was added 8.04 grams of 4-((4-dimethylaminophenyl)-2,6diphenyl)-6-phenyl thiapyrylium tetrafluoroboiate and 5.36 grams of 4-(4dimethylaminophenyl)-2-(4-ethoxyphenyl)-6-phenyl thiapyrylium tetrafluoroborate. The mixture was stirred mechanically for one hour; to the resulting solution was added 102 grams of high molecular weight bisphenol A polycarbonate, (Makrolon™ 5705 polycarbonate, obtained from Mobay Chemical Co.). After one houl additional stiiling, 238 grams of bisphenol A polycaibonate of lower molecular weight (Lexan 145™ polycarbonate, obtained from General Electric Co.) was added. The mixture was stirred ovemnight, then diluted with 211.5 grams of 1,1,2-tuichloroethane. The resulting slulTy was allowed to evaporate to dryness, and the residue was cut into small pieces. The high molecular weight polycarbonate referred to above was Makrolon 5705™ polycarbonate, obtained from Mobay Chemical Co. Its number average molecular weight, as determined by gel permeation chromatography, is 178,000 polystyrene equivalents. The low molecular weight polycarbonate above was Lexan 145™ polycarbonate, obtained from General Electric Co. Its number average molecular weight as determined by gel permeation chromatography is 51,600 polystyrene equivalents.

The aggregate photoconductive layer formulation was coated onto a 7 mil thick nickel-coated poly(ethylene terephthalate) support and allowed to dry and cool.

A commercial parallel-plate plasma reactor (PlasmaTherm Model 730) was used for deposition of the DLC protective layer onto the single layer photoconductive element whose preparation was described above. The DLC protective layer was deposited on the photoconductive layer. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 cubic meters), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. The single layer photoconductive element to which the DLC protective layer was to be applied was adhered to the lower electrode for deposition using double-stick tape. The element was coated at room temperature. The DLC protective layer was deposited on the photoconductive layer of the single layer photoconductive element.

The DLC protective layer was deposited onto the photoconductive layer of the photoconductive element by introducing 32 standard cubic centimeters per minute (sccm) acetylene and 116 sccm argon into the reactor. The reactor pressure and RF power were 13.2 Pa and 100 W, respectively. Deposition time was 4 minutes and 41 seconds.

Thickness of the DLC Protective Layer

Simultaneous deposition of the coating layer on a silicon wafer allowed measurement of coating thickness using ultraviolet/visible (UVIVIS) reflectometry. The thickness of the coating was measured to be 0.20 μm.

Composition of the DLC Protective Layer

The composition of the DLC protective layer of Example 1 was analyzed using X-ray photoelectron spectroscopy (XPS). The XPS spectra were obtained on a Physical Electronics 5601 photoelectron spectrometer with monochromatic Al Kα X-rays (1486.6 eV). All spectra were referenced to the C 1s peak for neutral (aliphatic) carbon atoms, which was assigned a value of 284.6 eV. Spectra were taken at a 45° electron takeoff angle (ETOA) which corresponds to an analysis depth of about 5 nm. Note that XPS is unable to detect hydrogen. The XPS results are presented in Table 2.

Latent Image Spread

Latent image spread (LIS) of the photoconductive element of Example 1 was measured using the method described by D. S. Weiss, J. R. Cowdery, W. T. Ferrar, and R. H. Young, *Proceedings of IS&T's Eleventh Iiternational Congress on Advances in Non-Impact Printing Technologies* 1995, 57, at low ambient relative humidity (RH) conditions (30–40% relative humidity) and at high ambient relative humidity (70% relative humidity) conditions.

The LIS measurement initially produces a square wave pattern in a plot of surface potential versus distance. For a photoconductive element undergoing LIS, as the image spreads, the corners of the square wave become rounded, and the width of the wave broadens. The width of the pattern is determined by drawing tangents to the sides of the wave and measuring the distance between the two tangents at the points where they intersect the baseline drawn between the unimaged portions of the wave. The width of the surface potential wave (image width) is measured as a function of time to determine the LIS. The result corresponding to no latent image spread would be an invariant image width as a function of time. Lower image widths and no change in image width as a function of time or of humidity are the desired results. The results of this type of LIS measurement can be correlated with performance of the photoconductor in an electrophotographic imaging machine. Results of the LIS measurements for Example 1 appear in Tables 3 and 4.

Sensitivity Testing

Photoinduced discharge measurements (sensitivity testing) were performed to measure the photosensitivity, residual voltage, and dark decay of the element. This involved charging the photoconductive element to 500 V, then exposing the photoconductive element to 680 nm radiation, and measuring the change in voltage as a function of time. The sensitivity ($cm^2$/erg) is defined as the reciprocal of the energy required to discharge the photoconductol from 500 V to 250 V and is denoted as $S^+$ when the polarity of the initial charge is positive and $S^-$ when the polarity of the initial charge is negative. The residual voltage is the final voltage on the photoconductive element and is denoted as $V_r^+$ when the polarity of the initial charge is positive and $V_r^-$ when the polarity of the initial charge is negative. An increase of approximately 6% in residual voltage is expected when a coating is applied to a photoconductor due to reflection losses introduced by the protective coating. The dark decay of the sample was measured by charging the sample to 500 V and monitoring the decrease in voltage without exposure to light over a 15 second period. Lower exposure energies, residual voltages, and dark decays are more desirable. Sensitivity testing was performed using positive and negative initial charging for the element. The results are shown in Table 5.

Scratch Testing

The resistance of the coated photoconductive element of Example 1 to physical damage was detemnined by scratch testing. A 2.5 $\mu$m diamond stylus was loaded with a 6 g load and dragged across the surface of the sample. The width of the scratch produced was measured using atomic force microscopy. Smaller scratch depths indicate greater resistance to physical damage. The results are shown in Table 6.

Adhesion Testing

Adhesion of the protective layer to the photoconductive layers was evaluated using the crosshatch adhesion test, a standard adhesion test. In this test, two thin lines are cut through the protective layer using a razor blade such that the lines form the shape of an "X." A piece of Scotch type 810 adhesive tape (3M Company, Minneapolis, Minn. is pressed over the entire "X"-shaped cut to ensure good adhesion at and around the cut. The tape is then pulled off the protective layer. If any of the protective layer is removed with the tape, then the element fails the test, indicating an adhesion problem between the protective layer and the photoconductive layers. If none of the protective layer is removed, the element passes the adhesion test. The element of this Example passed the adhesion test.

Resistance to Corona-Induced Damage

A photoconductive element in an electrophotographic process will typically be exposed to a corona generated by a charging element for less than one millisecond per process cycle. However, over the useful lifetime of a photoconductive element, the total time that a photoconductive element is exposed to a corona can total many hours. Thus, a method to measure the changes a photoconductive element would undergo as a result of many passes through the electrophotographic process cycle would be to subject the element to prolonged exposure to a corona and then measure the properties of the photoconductive element.

The test used here measures the ability of the photoconductive element to maintain its properties after repeated exposure to a corona during cycling in the electrophotographic process. This is a test of the resistance of the element to corona-induced damage. The resistance of the coated photoconductive element of Example 1 to corona-induced damage was determined by placing the sample in a corona charging unit at 7 kV for 20 minutes, with the DLC protective layer facing the charging unit, and then measuring the photosensitivity as described above. Results of the photosensitivity testing after corona exposure are shown in Table 7.

EXAMPLE 2

Bipolar Single Layer Photoconductive Element Having a Diamond-like Carbon Protective Layer B The photoconductive element of this Example was made as described in Example 1 except that the protective layer was a fluorinated diamond-like carbon that was deposited using the following gas types, flow rates, and deposition time. Inert argon gas was introduced at a flow rate of 96 sccm, and the reactive gases acetylene and hexafluoroethane were introduced into the reaction chamber at flow rates of 24 sccm and 8 sccm, respectively. The deposition time was 5 minutes and 9 seconds.

The thickness of the fluorinated DLC protective layer was 0.22 $\mu$m, determined a&s described in Example 1.

The composition determination, LIS measurements, sensitivity testing, scratch testing, and resistance to corona-induced damage for this example were performed as described in Example 1. The results are summarized in Tables 2–7.

The adhesion testing was performed as described in Example 1. The element of this Example passed the adhesion test.

EXAMPLE 3

Bipolar Single Layer Photoconductive Element Having a Diamond-like Carbon Protective Layer C The photoconductive element of this Example was made as described in Example 1 except that the protective layer was a fluorinated diamond-like carbon that was deposited using the following gas types, flow rates, and deposition time. Inert argon gas was introduced at a flow rate of 64 sccm, and the reactive gases acetylene and hexafluoroethane were introduced into the reaction chamber at flow rates of 16 sccm each. The deposition time was 4 minutes and 43 seconds.

The thickness of the fluorinated DLC protective layer was 0.17 $\mu$m, determined as described in Example 1.

The composition determination, LIS measurements, sensitivity testing, scratch testing, and resistance to corona-induced damage for this example were performed as described in Example 1. The results are summarized in Tables 2–7.

The adhesion testing was performed as described in Example 1. The element of this Example passed the adhesion test.

EXAMPLE 4

Bipolar Single Layer Photoconductive Element Having a Diamond-like Carbon Protective Layer D The photoconductive element of this Example was made as described in Example 1 except that the protective layer was a fluorinated diamond-like carbon that was deposited using the following gas types, flow rates, and deposition time. Inert argon gas was introduced at a flow rate of 32 sccm, and the reactive gases acetylene and hexafluoroethane were introduced into the reaction chamber at flow rates of 8 sccm and 24 sccm, respectively. The deposition time was 3 minutes and 38 seconds.

The thickness of the fluorinated DLC protective layer was 0.16 $\mu$m, determined as described in Example 1.

The composition determination, LIS measurements, sensitivity testing, scratch testing, and resistance to corona-induced damage for this example were performed as described in Example 1. The results are summarized in Tables 2–7.

The adhesion testing was performed as described in Example 1. The element of this Example passed the adhesion test.

EXAMPLE 5.

Bipolar Single Layer Photoconductive Element Having a Diamond-like Carbon Protective Layer E The photoconductive element of this Example was made as described in Example 1 except that the protective layer was a fluorinated diamond-like carbon that was deposited using the following gas types, flow rates, and deposition time. Inert argon gas was introduced at a flow rate of 12.8 sccm, and the reactive gases acetylene and hexafluoroethane were introduced into the reaction chamber at flow rates of 3.2 sccm and 28.8 sccm, respectively. The deposition time was 3 minutes and 38 seconds.

The thickness of the fluorinated DLC protective layer was 0.16 $\mu$m, determined as described in Example 1.

The composition determination, LIS measurements, sensitivity testing, scratch testing, and resistance to corona-induced damage for this example were performed as described in Example 1. The results are summarized in Tables 2–7.

The adhesion testing was performed as described in Example 1. The element of this Example passed the adhesion test.

COMPARATIVE EXAMPLE 1

Bipolar Single Layer Photoconductive Element with no Protective Layer

The bipolar single layer photoconductive element of the Example was prepared as described in Example 1 except that no protective layer was deposited on the surface of the photoconductive element.

The LIS measurements, sensitivity testing, scratch testing, and resistance to corona-induced damage for this Comparative Example were preformed as described in Example 1. The results are summarized in Tables 3, 5, 6, and 7.

Examples 1–5 and Comparative Example 1 demonstrate the improvements obtained with the bipolar photoconductive elements of this invention (Examples 1–5) over the prior ale (Comparative Example 1). For bipolar photoconductive elements having protective layers with a wide range of fluorine contents (Examples 1–5), no latent image spread (LIS) was observed under conditions of low ambient relative humidity. Under conditions of high ambient relative humidity, where prior art protective coatings such as sol-gel coatings are particularly susceptible to displaying LIS, the elements of this invention (Examples 1–5) also showed no LIS or deterioration of properties from the prior art (Comparative Example 1).

Sensitivity testing of the bipolar photoconductive elements of this invention demonstrated that these elements have sufficient sensitivity when charged positively or negatively to be classified as bipolar. Further, the testing demonstrates that the sensitivities, residual voltages, and dark decay values of the elements of this invention, under both positive and negative charging, are comparable to prior art (Comparative Example 1) and within the acceptable range for use of the elements in a commercial application. The adhesion testing also shows that the elements of this invention will not undergo premature failure in use and are acceptable for use in a commercial application.

Improvements obtained with the elements of this invention over prior art are demonstrated with the scratch and resistance to charge-induced damage testing. The scratch testing results in Table 6 show the significant improvement in resistance to physical damage obtained with the elements of the invention (Examples 1–5) compared to the prior alt (Comparative Example 1). The results in Table 7 show that, after extended exposure to the corona charging element, the bipolar photoconductive elements of this invention (Examples 1–5) continue to function as useful bipolar photoconductive elements. In contrast, the prior art photoconductive element (Comparative Example 1) no longer functions as a bipolar photoconductive element; it can no longer be used under positive initial charging conditions. This demonstrates the improvement to corona-induced damage obtained with the elements of this invention.

The following two comparative examples demonstrate the unexpected nature of the improvements obtained with this invention.

COMPARATIVE EXAMPLE 2

Positively Charging, Monopolar Photoconductive Element Having a Non-fluorinated DLC Protective Layer A positively charging monopolar photoconductive element having a diamond-like carbon protective layer was prepared as follows. First, a charge transport layer (CTL) solution was prepared by dissolving 57.5 wt % bisphenol-A polycarbonate Makrolon™ 5705 (Mobay Chemical Company), 2.5 wt % of a copolymer containing 55% ethylene terephthalate and 45% neopentyl terephthalate, 20 wt % of 1,1-bis(di-4-tolylaminophenyl)-cyclohexane, and 20 wt % tri-p-tolylamine to 10 wt % solids in dichloromethane. DC510 phenyl-methyl-substituted siloxane surfactant (Dow Corning) was added at a concentration of 0.01 wt % of the total CTL solution. The CTL solution was coated onto a nickel-coated poly(ethylene terephthalate) support to give a CTL layer with a dry thickness of 8.5 $\mu$m.

A first charge generation layer (CGL-I) solution was prepared by dissolving 28.4 wt % bisphenol-A-polycarbonate Makrolon™ 5705 (Mobay Chemical Company), 28.4 wt % bisphenol-A-polycaibonate Lexan™ 145 (General Electric Company, New York), 1.6 wt % 4-(4-dimethylaminophenyl)-2,6-diphenylthiapyrylium hexafluorophosphate, 0.4 wt % 4-(4-dimethylaminophenyl)-2-(4ethyoxyphenyl)-6-phenylthiapyrylium fluoroborate, and 39.2 wt % 1,1-bis(di-4-tolylaminophenyl)-cyclohexane, and 2 wt % "seed-B" into a 70/30 w/w dichloromethane/1,1,2-trichloroethane solvent mixture to give a 10% solids solution. DC510 surfactant was added at a concentration of 0.01 wt % of the total CGL-I solution. The "seed-B" consisted of 2.3 wt % 4-(4-dimethylaminophenyl)-2,6-diphenylthiapyrylium hexafluorophosphate, 1.5 wt % 4-(4-dimethylaminophenyl)-2-(4-ethyoxyphenyl)-6-phenylthiapyrylium fluoroborate, 67.3 wt % bisphenol-A-polycarbonate Makrolon™ 5705, and 28.9 wt % high molecular weight bisphenol-A-polycarbonate dissolved in a 70/30 w/w solvent mixture of dichloromethane and 1,1,2-trichloroethane. The CGL-I solution was coated on top of the CTL to give a CGL-I layer with a dry thickness of 10 $\mu$m.

A second charge generation layer (CGL-II) solution was prepared by dissolving 51.2 wt % bisphenol-A polycarbonate Makrolon™ 5705, 6.3 wt % 4(4-dimethylaminophenyl)-2,6-diphenylthiapyrylium hexafluorophosphate, 1.6 wt % 4-(4-dimethylaminophenyl)-2-(4-ethyoxyphenyl)-6-phenylthiapyrylium fluoroborate, 39.0 wt % 4-N,N-(diethylamino)tetraphenylmethane, and 1.9 wt % g "seed-B" into a 70/30 wlw dichloromethane/1,1,2-trichloroethane solvent mixture to give a 10% solids solution. DC510 suifactant was added at a concentration of 0.01 wt % of the total CGL-II solution. The CGL-II solution was coated over the CGL-I layer to give a CGL-II layer with a dry thickness of 4 $\mu$m.

A diamond-like carbon protective layer was deposited onto the CGL-II layer as described in Example 1, except that the following gas types, flow rates, and deposition time was used the following gas types and flow rates. Inert argon gas was introduced at a flow rate of 116 sccm, and the reactive gas acetylene was introduced into the reaction chamber at flow rate of 32 sccm. The deposition time was 3 minutes and 24 seconds.

The thickness of the non-fluonlnated DLC film was 0.15 μm, determined as described in Example 1.

The surface composition and LIS measurements for this example were determined as described in Example 1. The results are summarized in Tables 2–4.

COMPARATIVE EXAMPLE 3.

Negatively Charging, Monopolar Photoconductive Element Having a Non-fluorinated DLC Protective Layer A negatively charging, monopolar photoconductive element having a diamond-like carbon protective layer was prepared as follows. First, the CGL was coated onto a nickel-coated poly(ethylene terephthalate) Suppolt at a dry coverage of 6.57 g/m$^2$ (0.61 g/ft$^2$). The CGL coating mixture comprised 49.5 wt % polycarbonate (Lexan™ 145 available from General Electric Company), 2.5 wt % [poly(ethylene-co-2,2-dimethylpropylene terephthalate)], 39.25 wt % 1,1-bis-[4-(di-4-tolylamino)phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6pheylthiapyryliumm fluoroborate, and 2.4 wt % of the aggregate "seed" (a dried paste of the above CGL mixture which had been previously prepared). The CGL mixture was prepared at 9 wt % in an 80/20 (wt/wt) mixture of dichlor-omethane and 1,1,2-trichloroethane. A coating surfactant, DC510 (Dow Coming Corporation), was added at a concentration of 0.01 wt % of the total CGL mixture.

The CTL having a p-type charge transport material was coated onto the CGL at a dry coverage of 13.72 g/m$^2$ (1.275 g/ft$^2$). The CTL mixture comprised 60 wt % poly[4,4'-(2-norbornylidene)bisphenol terephthalate-co-azelate-(60/40)], 19.75 wt % 1,1-bis-[4-(di-4-tolylamino)phenyl] cyclohexane, 19.5 wt % tri-(4-tolyl)amine, and 0.75 wt % diphenylbis-(4-diethylaminophenyl)methane. The CTL mixture was prepared at 10 wt % in a 70/30 (wt/wt) mixture of dichloromethane and methyl acetate. A coating surfactant, DC510, was added at a concenftation of 0.024 wt % of the total CTL mixture. After the CGL and CTL layers had dried, a diamond-like carbon protective layer was deposited onto the CTL by plasma-enhanced chemical vapor deposition using a hydrocarbon feed gas, as described in Example 1. The protective layer was composed of carbon, hydrogen, and oxygen only; no fluorine was present.

The surface composition and LIS measurements for this example were determined as described in Example 1. The results are summarized in Tables 2–4.

Comparative Examples 2 and 3 demonstrate that a protective layer that is useful on a positively charging photoconductive element will be not necessarily be useful when a photoconductive element is charged negatively instead. Whereas the non-fluorinated DLC protective layer used on the positively charging, monopolar photoconductive element in Comparative Example 2 provides a useful photoconductive element in Comparative Example 2; the non-fluorinated DLC protective layer used on the negatively charging monopolar photoconductive element in Comparative Example 3 causes latent image spread (LIS) at low and high ambient relative humidities. The prior art does not teach how to solve the problem of a protective layer that works well on a monopolal photoconductive element that is charged with one polarity but that does not work well on a monopolar photoconductive element that is charged with the opposite polarity. Thus, it is not obvious that any protective layer that is useful on a monopolar photoconductive element, in which the layer will be subjected to only one polarity of charging, will be useful on a bipolar photoconductive element, in which the protective layer must be useful under both charging polarities.

TABLE 2

COMPOSITION OF THE PROTECTIVE LAYER

| Example or Comparative Example | Elemental Composition | | |
|---|---|---|---|
| | Carbon (%) | Fluorine (%) | Oxygen (%) |
| Ex. 1 | 90.1 | 0.0 | 8.9 |
| Ex. 2 | 86.5 | 3.7 | 8.9 |
| Ex. 3 | 77.2 | 13.7 | 8.5 |
| Ex. 4 | 56.6 | 37.7 | 5.0 |
| Ex. 5 | 46.4 | 49.9 | 3.2 |
| Comp. Ex. 2 | 88.4 | 0.0 | 10 |
| Comp. Ex. 3 | 90.2 | 0.0 | 9.7 |

TABLE 3

LIS MEASURED AT LOW AMBIENT RELATIVE HUMIDITY CONDITIONS (45–48% RH)

| Time (sec) | Image width (mm) | | | | | | | |
|---|---|---|---|---|---|---|---|---|
| | Ex. 1 | Ex. 2 | Ex. 3 | Ex. 4 | Ex. 5 | Comp. Ex. 1 | Comp. Ex. 2 | Comp. Ex. 3 |
| 0 | 2.99 | 2.99 | 2.99 | 3.04 | 2.99 | 3.02 | 3.05 | 3.30 |
| 60 | 2.99 | 2.99 | 3.01 | 2.95 | 3.01 | 3.01 | 3.00 | 3.36 |
| 150 | 2.97 | 3.02 | 3.01 | 2.95 | 3.06 | 3.01 | 3.00 | 3.41 |
| 300 | 3.01 | 2.97 | 3.01 | 2.97 | 3.02 | 3.01 | 3.05 | 3.50 |
| 600 | 3.01 | 3.01 | 3.01 | 2.99 | 3.01 | 3.02 | 3.00 | 3.52 |
| 1200 | 2.97 | 2.99 | 3.01 | 2.99 | 3.05 | 3.01 | 3.05 | 3.63 |
| 1800 | 2.99 | 2.97 | 3.02 | 3.02 | 3.04 | 2.99 | 3.00 | 3.68 |

TABLE 4

LIS MEASURED AT HIGH AMBIENT RELATIVE HUMIDITY (65–73% RH)

| Time (sec) | Image width (mm) | | | | | | |
|---|---|---|---|---|---|---|---|
| | Ex. 1 | Ex. 2 | Ex. 3 | Ex. 4 | Ex. 5 | Comp. Ex. 2 | Comp Ex. 3 |
| 0 | 3.04 | 3.02 | 3.02 | 2.99 | 3.01 | 3.00 | 3.30 |
| 60 | 3.04 | 2.99 | 3.01 | 3.02 | 2.97 | 3.10 | 3.38 |
| 150 | 3.02 | 2.99 | 3.01 | 3.02 | 2.99 | 3.05 | 3.43 |
| 300 | 3.04 | 3.04 | 3.01 | 3.02 | 2.99 | 3.05 | 3.57 |
| 600 | 3.01 | 3.04 | 3.02 | 3.04 | 3.01 | 3.05 | 3.58 |
| 1200 | 2.99 | 3.04 | 3.01 | 3.02 | 3.01 | 3.10 | 3.77 |
| 1800 | 3.01 | 3.02 | 2.97 | 3.04 | 3.02 | 3.05 | 3.89 |

TABLE 5

SENSITIVITY TESTING RESULTS

| Example or Comparative Example | $S^+$ ($cm^2$/–erg) | $V_r^+$ (V) | Dark decay under positive initial charging (V) | $S^-$ ($cm^2$/–erg) | $V_r^-$ (V) | Dark decay under negative initial charging (V) |
|---|---|---|---|---|---|---|
| Example 1 | 0.294 | 37 | 15 | 0.217 | 12 | 0 |
| Example 2 | 0.303 | 30 | 15 | 0.213 | 18 | 0 |
| Example 3 | 0.270 | 31 | 12 | 0.227 | 20 | 0 |
| Example 4 | 0.313 | 32 | 3 | 0.244 | 16 | 0 |
| Example 5 | 0.313 | 37 | 5 | 0.294 | 15 | 0 |
| Comparative Example 1 | 0.392 | 32 | 13 | 0.250 | 12 | 0 |

TABLE 6

SCRATCH TESTING RESULTS

| Example or Comparative Example | Scratch Width (μm) |
|---|---|
| Example 1 | 13.6 |
| Example 2 | 11.4 |
| Example 3 | 13.5 |
| Example 4 | 13.2 |
| Example 5 | 13.6 |
| Comparative Example 1 | 13.9 |

TABLE 7

SENSITIVITY TESTING RESULTS AFTER EXPOSURE TO CORONA CHARGING ELEMENT

| Example or Comparative Example | $S^+$ ($cm^2$/erg) | ($cm^2$/erg) |
|---|---|---|
| Example 1 | 0.323 | 0.192 |
| Example 2 | 0.333 | 0.204 |
| Example 3 | 0.333 | 0.213 |
| Example 4 | 0.345 | 0.256 |
| Example 5 | 0.385 | 0.256 |
| Comparative Example 1 | —* | 0.208 |

*Element would not accept charge to +500 V, indicating loss of useful function.

TABLE 8

REFERENCE TABLE FOR EXAMPLES AND COMPARATIVE EXAMPLE

| Example or Comparative Example | Protective Layer Description | Protective Layer Thickness (μm) |
|---|---|---|
| Example 1 | DLC with no fluorine | 0.20 |
| Example 2 | DLC with 3.7% fluorine | 0.22 |
| Example 3 | DLC with 13.7% fluorine | 0.17 |
| Example 4 | DLC with 37.7% fluorine | 0.16 |
| Example 5 | DLC with 49.9% fluorine | 0.16 |
| Comparative Example 1 | no protective layer | |

All Examples and Comparative Example were single layer aggregate photoconductors.

All Examples and the Comparative Example were single layer aggregate photoconductors.

The invention has been described in detail with particular reference to certain preferred embodiments thereof, but it will be understood that variations and modifications can be effected within the spirit and scope of the invention.

What is claimed is:

1. A bipolar electrophotographic element comprising a) a single active photoconductive layer on an electrically conductive support; and b) a diamond-like carbon protective layer having a fluorine content between 0 and 65 atomic percent based on the composition of the entire protective layer, and a thickness between 0.05 and 0.5 μm.

2. A bipolar electrophotographic element according to claim 1 wherein the single active photoconductive layer comprises:

i) an aggregate photoconductive material comprising an electrically insulating, continuous polymer phase and heterogeneously dispersed therein a complex of (a) at least one polymer having an alkylidene diarylene group in a recurring unit, and (b) at least one pyrylium dye salt; and ii) at least one organic charge transport agent in the continuous polymer phase.

3. A bipolar electrophotographic element according to claim 2 wherein the polymer phase is a mixture of at least two polymers, at least one of which is an aggregating polycarbonate.

4. A bipolar electrophotographic element according to claim 2 wherein said polymer is a bisphenol-A polycarbonate.

5. A bipolar electrophotographic element according to claim 2 wherein said dye salt is a thiapyrylium salt.

6. A bipolar electrophotographic element according to claim 5 wherein said thiapyrylium salt is selected from 4-((4-dimethylaminophenyl)- 2,6-diphenyl)-6-phenylthiapyrylium hexafluorphosphate and 4-(4dimethylaminophenyl)-2(4-ethoxyphenyl-6-phenylthiapyrylium tetrafluoroborate.

7. A bipolar electrophotographic element according to claim 2 wherein the photoconductive layer contains at least one organic charge transport agent selected from tri-p-tolylamine, 1,1-bis(di-4-tolylaminophenyl)cyclohexane, 1,4-bis(di-4-tolylamostyryl)benzene, 1,1-bis (di-4-tolylaminophenyl)-3-n-propylbenzene, and 4,4'-bis (diethylamino)tetraphenylmethane.

8. A bipolar electrophotographic element according to claim 1 wherein said protective layer has a fluoine content between 10 and 65 atomic percent based on the composition of the entire protective layer.

9. A bipolar electrophotographic element according to claim 1 wherein said protective layer has a fluorine content between 25 and 50 atomic percent based on the composition of the entire protective layer.

10. A bipolar electrophotographic element according to claim 1 wherein the thickness of said protective layer is between 0.15 and 0.35 μm.

11. A bipolar electrophotographic element according to claim 1 wherein the protective layer is a single layer.

12. A bipolar electrophotographic element according to claim 1 wherein the protective layer further contains oxygen or hydrogen.

13. A coating composition for a single bipolar photoconductive layer comprising:

i) one or more binder polymers;

ii) at least one aggregating dye salt;

iii) at least one organic charge transport agent; and iv) a volatile coating solvent.

14. The coating composition of claim 13 wherein one or more binder polymer is an aggregating polycarbonate.

15. The coating composition of claim 13 wherein one or more binder polymer is a bisphenol-A polycaibonate.

16. The coating composition of claim 13 wherein at least one aggregating dye salt is a pyrylium dye salt.

17. The coating composition of claim 13 wherein at least one aggregating dye salt is a thiapyrylium dye salt.

18. A method of making a single bipolar photoconductive layer comprising coating the composition of claim 13 onto an electrically conductive support and drying said composition on said support.

19. A method of making a bipolar photoconductive element comprising:

forming a protective layer containing diamond-like carbon on the bipolar photoconductive layer formed by the method of claim 18 by contacting said bipolar photoconductive layer with at least one feed gas selected from a hydrocarbon compound and a fluorocarbon compound in their gas phase, and decomposing said compounds in their gas phase by plasma-enhanced chemical vapor deposition.

20. The method of claim 19 wherein the diamond-like carbon protective layer contains fluorine between 0 and 65 atomic percent based on the composition of the entire protective layer and wherein the thickness of said protective layer is between 0.05 and 0.5 $\mu$m.

21. The method of claim 19 wherein the hydrocarbon compound is selected from the group consisting of paraffinic hydrocarbons represented by the formula $C_nH_{2n+2}$, where n is 1 to 10; olefinic hydrocarbons represented by formula $C_nH_{2n}$, where n is 2 to 10; acetylenic hydrocarbons represented by $C_nH_{2n-2}$where n is 2 to 10; alicyclic hydrocarbons; and aromatic compounds.

22. The method of claim 19 wherein the fluorocarbon compound is selected from the group composed of paraffinic fluorocarbons represented by the formula $C_nF_xH_y$, where n is 1 to 10, x+y=2n+2, and x is 3 to 2n+2; olefinic fluorocarbons represented by the formula $C_nF_xH_y$, where n is 2 to 10, x+y=2n, and x is 2 to 2n; acetylenic fluorocarbons represented by $C_nF_xH_y$, where n is 2 to 10, x+y=2n−2, and x is 1 to 2n−2; alkyl metal fluorides; aryl fluorides; alicyclic fluorides; styrene fluorides; fluorine-substituted silanes; fluorinated ketones; and fluorinated aldehydes.

23. An electrophotographic apparatus comprising the bipolar electophotographic element of claim 1 or 2, in combination with:

a) a charging means;

b) an exposure means;

c) a development station including electrophotographic developer;

d) a transfer means; and e) a fusing means.

* * * * *

UNITED STATES PATENT AND TRADEMARK OFFICE

CERTIFICATE OF CORRECTION

PATENT NO. : 6,020,097
DATED : Feb. 1, 2000
INVENTOR(S) : Susan A. Visser, et al It is certified that error appears in the above-indentified patent and that said Letters Patent is hereby corrected as shown below:

| | |
|---|---|
| column 22, line 31 | -- hexafluorophosphate -- |
| column 22, line 32 | -- 4-(4-dimethylaminophenyl) -- |
| column 22, line 32 | -- -2-(4-ethoxyphenyl-6-phenylthiapyrylium -- |
| column 22, line 38 | -- tolylaminostyryl -- |
| column 22, line 42 | -- fluorine -- |
| column 22, line 67 | -- polycarbonate -- |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*